US006013886A

United States Patent [19]

Gimeno et al.

[11] Patent Number: 6,013,886

[45] Date of Patent: Jan. 11, 2000

[54] HIGH-SPEED CONTROL DEVICE FOR A HIGH VOLTAGE CONNECTION APPARATUS, IN PARTICULAR A GROUNDING DISCONNECTOR

[75] Inventors: Carmelo Gimeno, Aarau; André Dossegger, Oberentfelden; Christian Tschannen, Unterentfelden, all of Switzerland

[73] Assignee: GEC Alsthom T & D AG, Oberentfelden, Switzerland

[21] Appl. No.: 09/127,693

[22] Filed: Jul. 31, 1998

[30] Foreign Application Priority Data

Jul. 31, 1997 [FR] France ..... 97 09789

[51] Int. Cl.[7] ..... H01H 3/30

[52] U.S. Cl. ..... 200/400; 74/569

[58] Field of Search ..... 200/400; 74/569, 74/97.1

[56] References Cited

U.S. PATENT DOCUMENTS 4,524,637 6/1985 Yoshizumi ..... 74/569

4,681,993 7/1987 Kondo et al. ..... 74/569 X 5,641,059 6/1997 Wilde et al. ..... 200/400

FOREIGN PATENT DOCUMENTS 0 372 449 A1 6/1990 European Pat. Off. .

19 62 091 U 6/1967 Germany .

31 14727A1 10/1982 Germany .

*Primary Examiner*—Renee S. Luebke

*Attorney, Agent, or Firm*—Sughrue, Mion, Zinn, Macpeak & Seas, PLLC

[57] ABSTRACT

The invention relates to a high-speed control device for a high voltage connection apparatus, in particular a ground disconnector, which apparatus is fitted with a moving contact. The device comprises a spring for storing mechanical energy, a cocking mechanism for cocking the spring and comprising an electric motor organized to drive a first rotary part, a pivot arm, a second rotary part, and a latch organized to cooperate with said second rotary part to define two stable positions. The pivot arm carries the first pin organized to co-operate with two bearing surfaces of said first rotary part, and a second pin organized to co-operate with the two bearing surfaces of said second rotary part. The device makes it possible to obtain two stable latching points that are disposed at 180° from each other.

6 Claims, 2 Drawing Sheets

HIGH-SPEED CONTROL DEVICE FOR A HIGH VOLTAGE CONNECTION APPARATUS, IN PARTICULAR A GROUNDING DISCONNECTOR

The present invention relates to a high-speed control device for a high voltage connection apparatus, in particular for a grounding disconnector, the apparatus being fitted with a moving contact, the device having a spring for storing mechanical energy, a cocking mechanism for cocking the spring and comprising an electric motor organized to drive a first rotary part, a pivot arm, a second rotary part, latching means organized to co-operate with said second rotary part to define two stable positions, said pivot arm carrying a first pin organized to co-operate with two bearing surfaces of said first rotary part and a second pin organized to co-operate with two bearing surfaces of said second rotary part, and a drive mechanism for driving said moving contact.

BACKGROUND OF THE INVENTION

Devices of that type are already known, in particular the mechanism described by U.S. Pat. No. 4 681 993 which includes a spring whose rod is hinged on a fork-shaped link, secured to a shaft which, depending on the embodiment, can be different from the respective shafts of a disk for tensioning the spring and of a drive disk. In one of the embodiments, the tensioning disk and the drive disk are mounted on a common shaft which therefore requires two bearings to be provided in the housing.

The drawback of that mechanism is due in particular to the fact that the working angle, i.e. the angle through which the link is coupled to the rod of the spring is much less than 180°.

Another device of that type is described in publication DE-U-1 962 091 in which the mechanism has locking means at its dead points which are offset relative to one another by a pivot angle of 180°. It also has a hook-shaped coupling bar.

OBJECT AND SUMMARY OF THE INVENTION

The present invention provides a high-speed control device as defined in the preamble and having two stable locking points that are at 180° from each other.

In the device the pivot arm and the first rotary part are respectively mounted on two shafts on a common axis, and the spring for storing mechanical energy is coupled to the pin that is organized to co-operate with said first rotary part.

In a preferred embodiment, the pivot arm is freely mounted on a hollow shaft rigidly linked to the second rotary part.

The spring for storing mechanical energy is preferably a helical spring. It is advantageously coupled to the pivot arm by a coupling member. The coupling member is preferably a chain. The chain preferably passes over a deflector pulley, thereby saving space.

In a particularly advantageous embodiment, the pins are constituted by two ends of a segment of shaft passing through the pivot arm.

BRIEF DESCRIPTION OF THE DRAWINGS

The present invention will be better understood with reference to the description of a preferred embodiment and the accompanying drawings given by way of nonlimiting example and in which.

MORE DETAILED DESCRIPTION

Figure 1:
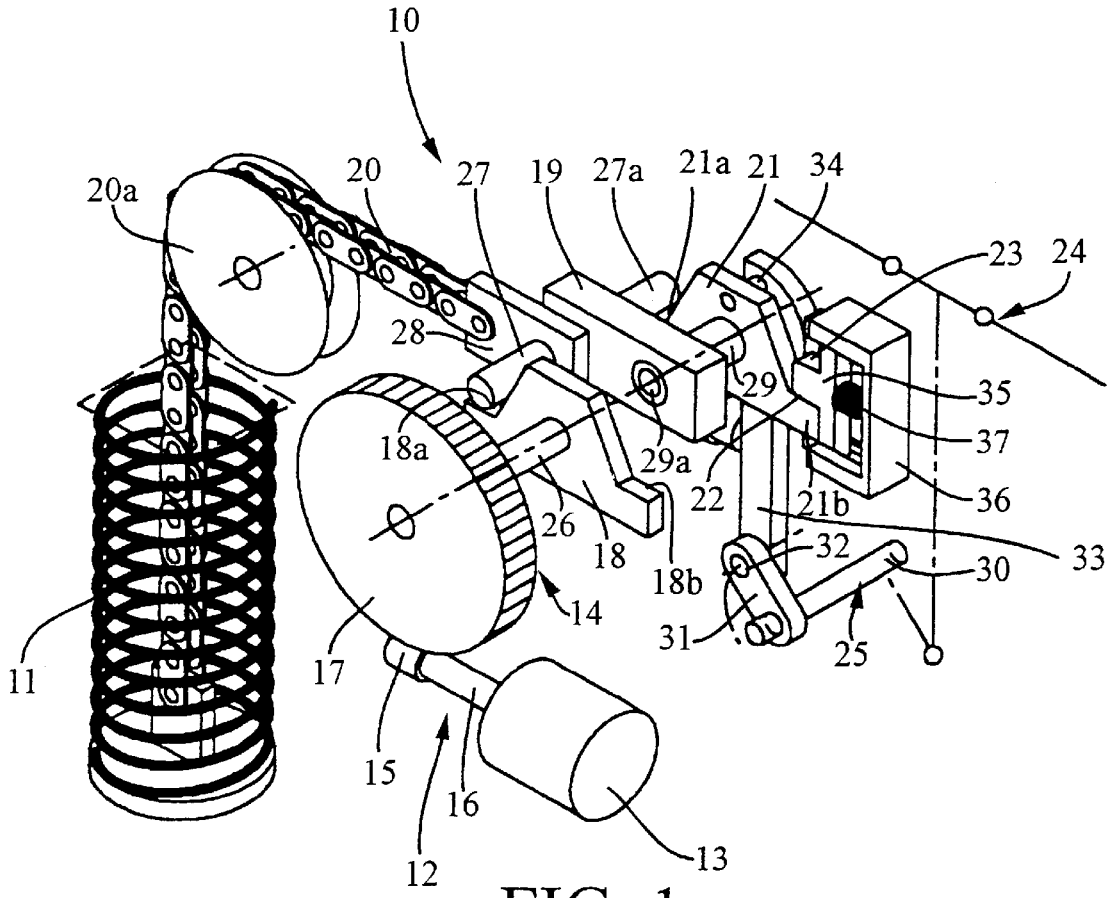
FIG. 1 shows a device of the invention in a first state in which the moving contact is closed and the spring is relaxed.

The high-speed control device 10 for a gas-insulated grounding disconnector as shown in FIGS. 1 to 4 mainly comprises the following components:

- a spring 11 for storing mechanical energy;
- a cocking mechanism 12 for cocking the spring and comprising an electric motor 13 and a stepdown gear 14 constituted, in the example shown, by a drive worm 15 mounted on the shaft 16 of the electric motor 13 and a gear wheel 17 meshing with the drive worm 15;
- a first rotary part 18 driven by the cocking mechanism 12 and coupled to a pivot arm 19 connected to said spring 11;
- a coupling member 20, constituted in particular by a chain, which passes via a deflector pulley 20a to couple the pivot arm 19 to the spring 11 for storing mechanical energy;
- a second rotary part 21 driven by said pivot arm 19, said part being organized to co-operate with dead point abutments 22 and 23 associated with a moving contact 24; and
- a drive mechanism 25 for driving the moving contact 24.

The first rotary part 18 is mounted on the shaft 26 of the gear wheel 17 and has two bearing surfaces 18*a* and 18*b* extending radially in diametrically opposite directions, which surfaces are organized to co-operate as abutments with a pin 27 mounted parallel to the shaft 26 on a part 28 which is hinged on the pivot arm 19, and to which the free end of the chain 20 is fixed. The pin 27 co-operates respectively with the bearing surface 18*a* when the first part 18 is in a first position as shown in particular in FIG. 1, and with the bearing surface 18*b* when the first rotary part 18 is in a second position as shown in particular in FIG. 3, said rotary part 18 having rotated through 180° between these two positions.

The pin 27 is preferably constituted by the end of a shaft passing through the pivot arm 19 and extended on the other side of the arm in the form of a pin 27*a* organized to co-operate with two bearing surfaces 21*a* and 21*b* of the second rotary part 21 which is secured to a hollow shaft 29 on which the pivot arm 19 can pivot.

The hollow shaft 29 is in the form of a cylindrical part mounted on a common axis about a solid shaft 29*a*. The pivot arm 19 is free to rotate about the hollow shaft 29, and the assembly constituted by the hollow shaft 29 and the second rotary part 21 is free to rotate about the solid shaft 29*a* which is fixed.

In one of the positions of the pivot arm 19, e.g. as shown in FIG. 1, and corresponding to a first position of the second rotary part 21, the pin 27*a* is in abutment against the bearing surface 21*a* of said second rotary part 21.

Figure 2:
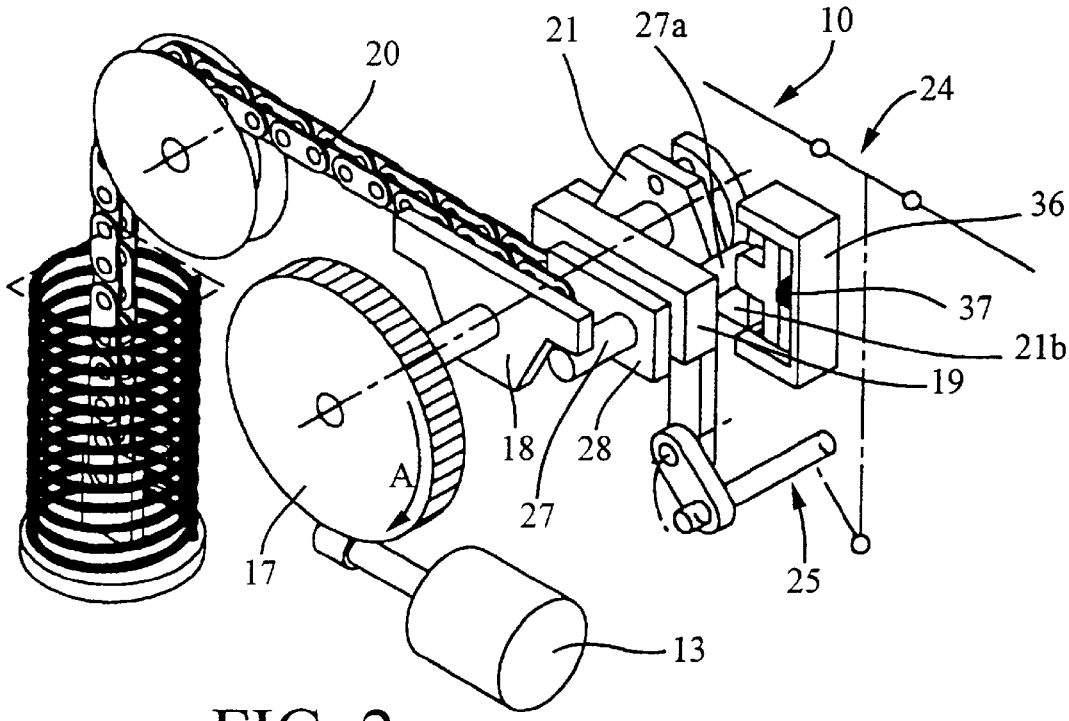
FIG. 2 shows the device of the invention in a second state in which the moving contact is closed and the spring is cocked.
Figure 3:
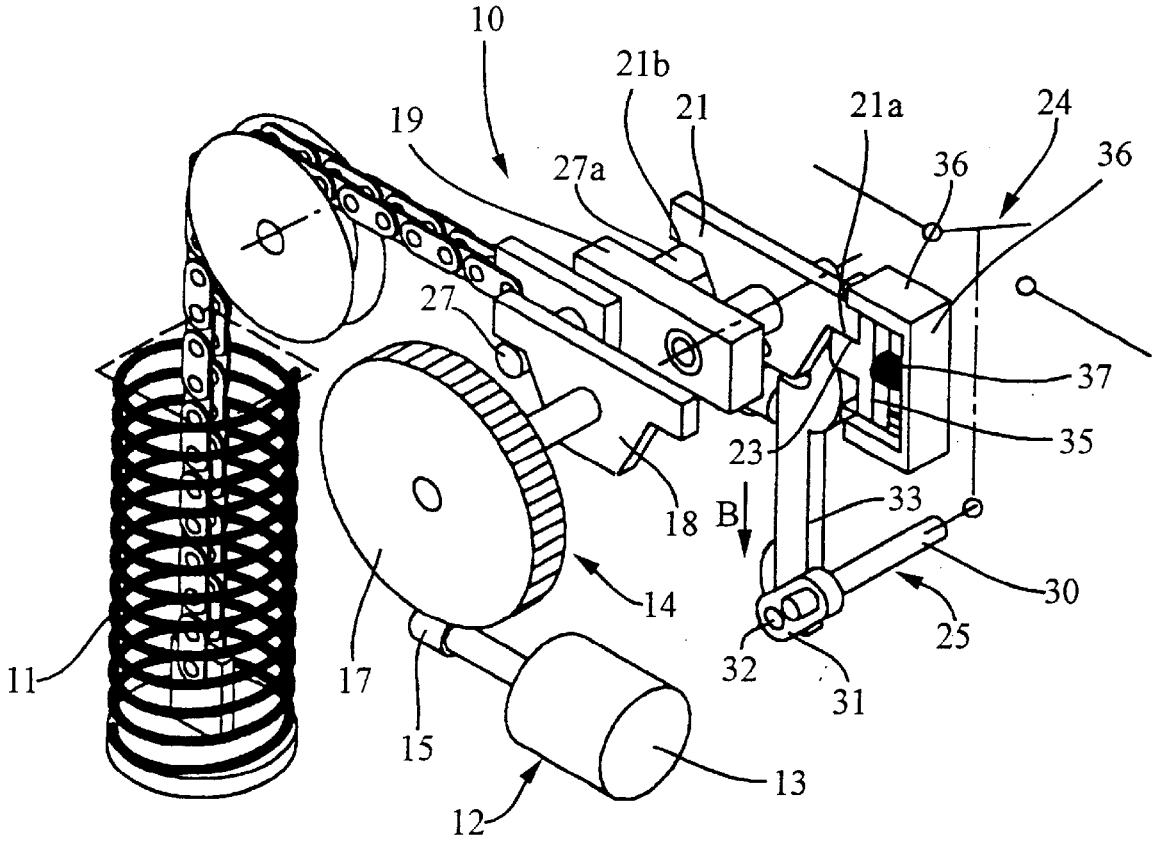
FIG. 3 shows the device of the invention in a third state in which the moving contact is open and the spring is relaxed.

In a second position of the pivot arm 19, reached after pivoting through 180° and shown, for example, in FIG. 2, which position always corresponds to the initial position of the second rotary part 21, the pin 27*a* is in abutment against the bearing surface 21*b* of said second rotary part 21.

The drive mechanism 25 of the moving contact 24 has a shaft 30 carrying a rocking lever 31 on which a fixed pivot shaft 32 is fixed which is itself connected by a link 33 to a pivot shaft 34 that is fixed eccentrically on the second rotary part 21. The bearing surfaces 21*a* and 21*b* of the second rotary part 21 are organized to co-operate respectively with a moving latch 35 carrying the dead point abutments 22 and 23 and housed in a housing 36. A thrust spring 37 is placed in the housing and urges the moving latch 35 forwards into a position where the bearing surfaces 21*b* and 21*a* are pressed respectively against the dead point abutments 22 and 23 (see FIGS. 1 and 3 respectively).

In the disposition shown in FIG. 1, the moving contact 24 is closed and the spring 11 for storing mechanical energy is relaxed. In this state, the high-speed control device is inoperative. To make it operational, the spring 11 must be cocked, and that has been performed when the device is in the state shown in FIG. 2.

To reach this disposition, the motor 13 is activated so as to rotate the gear wheel 17 in the direction of arrow A through an angle of 180°. Following this rotation, the first rotary part 18 is also rotated through 180°, entraining the pivot arm 19 via the pin 27 and cocking the spring 11 by means of the hinged part 28 and the chain 20. As a result, the pin 27*a* pivots through 180° to bear against the bearing surface 21*b* of the second rotary part 21 after pushing back the moving latch 35 into the housing 36 against the action of the thrust spring 37.

The moving contact 24 remains closed and the drive mechanism 28 remains in the same position as in FIG. 1. Nevertheless, the spring 11 is cocked and the high-speed control device is operational. For it to operate, the motor 13 must drive the gear wheel 17 in the direction of arrow A until the first rotary part 18, and consequently the pivot arm 19, have gone past their dead point. At this moment, the force of the spring 11, as transmitted by the chain 20, exerts very powerful traction on the hinged part 28 and drives the pivot arm 19 in rotation through an angle of 180° until it occupies the position shown in FIG. 3. Rotation of the pivot arm 19 causes the second rotary part 21 driven by the pin 27*a* also to rotate, which part is likewise secured to the pivot arm 19.

During this movement, or more exactly during its initial stage, the pin 27*a* releases the moving latch 35 which is pushed forward from the housing 36 by the thrust spring 37. In the final stage of this movement, the bearing surface 21*a* of the second rotary part 21 returns to bear against the dead point abutment 23 of the moving latch 35 which has been pushed into position by the thrust spring 37 during the initial stage of the movement.

Rotation of the second moving part 21 through 180° has moved the link 33 in the direction of arrow B, thereby rocking the rocking lever 31 and rotating the shaft 30, thus opening the moving contact 24.

Figure 4:
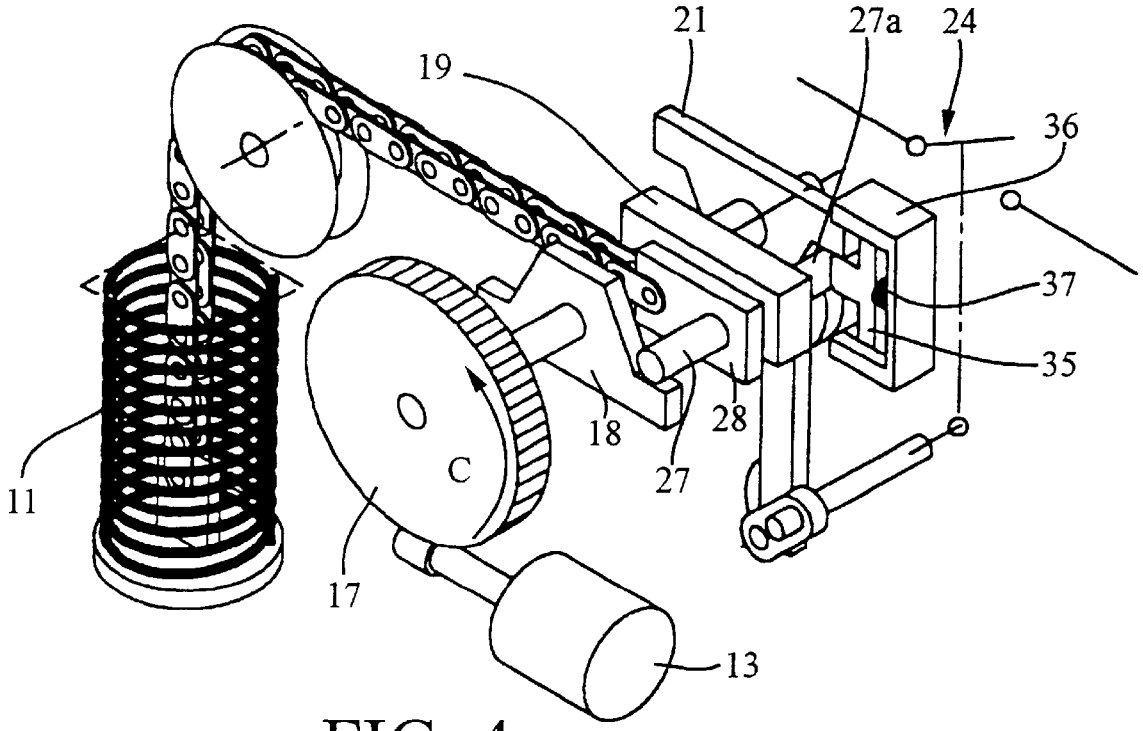
FIG. 4 shows the device of the invention in a fourth state in which the moving contact is open and the spring is cocked.

At the end of this procedure, the moving contact 24 is open and the spring 11 for storing mechanical energy is relaxed. To make the device operational again, the spring 11 must be cocked again. This is done during an operation whose result is shown in FIG. 4.

The motor 13 is controlled to drive the gear wheel 17 in the direction of arrow C, i.e. in the direction opposite to that of arrow A in FIG. 2. This rotation of the gear wheel rotates the first rotary part 18 through 180°, thereby pivoting the pivot arm 19 as actuated by the pin 27 through 180°.

The displacement of the hinged piece 28 on the pivot arm 19 causes the spring 11 for storing mechanical energy to be cocked. The pin 27*a* causes the moving latch 35 to be withdrawn into the housing 36 against the thrust force from the spring 37. The other components of the device are not subjected to displacement during this stage.

To close the moving contact 24, it suffices to control the motor 13 so that the first rotary part 18 and the pivot arm 19 go past their dead point, thereby instantaneously causing the force of the spring 11 to be released and rotating the second rotary part 21, consequently closing the moving contact 24.

The cycle can be repeated indefinitely by driving the motor 13 in one direction and in the other direction in alternation.

The present invention is not limited to the embodiment described, but it extends to any variant that is obvious to the person skilled in the art.

We claim:

1. A high-speed control device for a high voltage grounding disconnector, the grounding disconnector being fitted with a moving contact, the device having:

a spring for storing mechanical energy, a first rotary part, a second rotary part, a cocking mechanism for cocking the spring and comprising an electric motor operative to drive said first rotary part, a pivot arm, carrying a first pin operative to co-operate with two bearing surfaces of said first rotary part and a second pin operative to co-operate with two bearing surfaces of said second rotary part, a latching mechanism operative to co-operate with said second rotary part to define two stable positions, and a drive mechanism for driving said moving contact, wherein the pivot arm and the first rotary part are respectively mounted on two shafts on a common axis, wherein the spring for storing mechanical energy is coupled to the first pin that is operative to co-operate with said first rotary part and wherein the pivot arm is freely mounted on a hollow shaft rigidly linked to the second rotary part.

2. A device according to claim 1, wherein the pins are constituted by two ends of a segment of shaft passing through the pivot arm.

3. A device according to claim 1, wherein the spring for storing mechanical energy is a helical spring.

4. A device according to claim 1, wherein the spring for storing mechanical energy is coupled to the pivot arm by a coupling member.

5. A high-speed control device for a high voltage grounding disconnector, the grounding disconnector being fitted with a moving contact, the device having:

a spring for storing mechanical energy, a first rotary part, a second rotary part, a cocking mechanism for cocking the spring and comprising an electric motor operative to drive said first rotary part, a pivot arm, carrying a first pin operative to co-operate with two bearing surfaces of said first rotary part and a second pin operative to co-operate with two bearing surfaces of said second rotary part, a latching mechanism operative to co-operate with said second rotary part to define two stable positions, and a drive mechanism for driving said moving contact, wherein the pivot arm and the first rotary part are respectively mounted on two shafts on a common axis, wherein the spring for storing mechanical energy is coupled to the first pin that is operative to co-operate with said first rotary part, wherein the spring for storing mechanical energy is coupled to the pivot arm by a coupling member and wherein the coupling member is a chain.

6. A device according to claim 5, wherein the chain passes over a deflector pulley.

* * * * *